United States Patent [19]

Skinner

[11] 4,176,640

[45] Dec. 4, 1979

[54] FUEL INJECTION PUMPING APPARATUS

[75] Inventor: Robert T. J. Skinner, High Wycombe, England

[73] Assignee: Lucas Industries, Limited, Birmingham, England

[21] Appl. No.: 787,521

[22] Filed: Apr. 14, 1977

[30] Foreign Application Priority Data

Apr. 20, 1976 [GB] United Kingdom ..... 15899/76

[51] Int. Cl.[2] ..... F02M 59/34; F02M 41/06

[52] U.S. Cl. ..... 123/139 AQ; 123/139 AL; 123/139 BC; 123/140 FG

[58] Field of Search ..... 123/139 BD, 139 AQ, 123/140 FG, 139 AL, 139 BC; 417/540; 138/44

[56] References Cited

U.S. PATENT DOCUMENTS

| | | | |
|---|---|---|---|
| 2,746,442 | 5/1956 | Roosa | 123/139 BC |
| 2,916,029 | 12/1959 | Kemp | 123/139 AQ |
| 3,363,568 | 1/1968 | Evans | 123/140 FG |
| 3,439,624 | 4/1969 | Glikin et al. | 123/139 AQ |
| 3,486,492 | 12/1969 | Lehnerer | 123/139 AQ |
| 3,552,366 | 1/1971 | Kemp | 123/139 AQ |
| 3,741,182 | 6/1973 | Wade et al. | 123/140 FG |
| 3,759,239 | 9/1973 | Regneault et al. | 123/140 FG |
| 4,050,433 | 9/1977 | Tokashiki | 123/140 FG |

*Primary Examiner*—Charles J. Myhre
*Assistant Examiner*—Andrew M. Dolinar

[57] ABSTRACT

A fuel injection pumping apparatus includes an injection pump to which fuel is supplied by a throttle from a feed pump. The injection pump includes a piston which is movable to adjust the timing of delivery of fuel. The throttle comprises an axially movable member which is spring loaded against the action of the pressure of fuel delivered by the feed pump and formed in the throttle is a blind drilling which communicates with a groove. A port is in constant communication with the groove and is connected to the cylinder containing the piston. A port is in variable communication with the groove and communicates with an inlet through which fuel is supplied to the injection pump. The axial setting of the member determines the amount of fuel supplied to the engine and the drilling is formed as or includes a restrictive orifice. The pressure downstream of this orifice varies in accordance with the outlet pressure of the feed pump and also the quantity of fuel which is being supplied to the engine.

4 Claims, 1 Drawing Figure

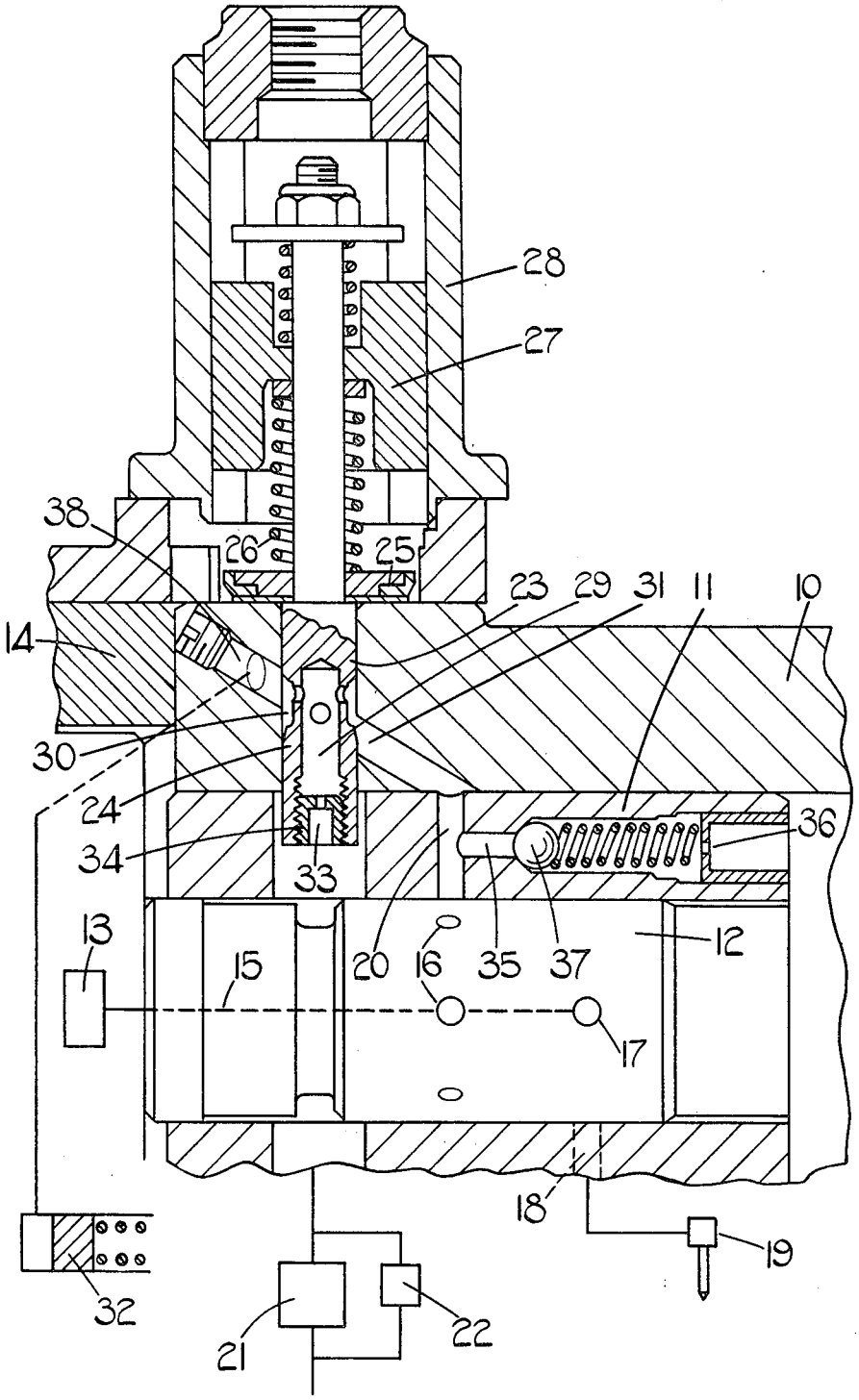
28
27
38
26
25
23
29
31
11
10
14
30
24
34
33
36
13
15
20
16
35
37
12
17
18
19
32
21
22

FUEL INJECTION PUMPING APPARATUS

This invention relates to fuel injection pumping apparatus of the kind comprising an injection pump operable to deliver fuel during a delivery stroke, a feed pump for supplying fuel to the injection pump during a filling stroke, a valve for controlling the output pressure of the feed pump so that the pressure varies in accordance with the speed at which the apparatus is driven, a throttle for varying the quantity of fuel supplied by the feed pump to the injection pump, said throttle comprising an axially movable member which is subjected at one end to said pressure and is movable by an increase in said pressure against the action of resilient means in a direction to reduce the amount of fuel supplied by the feed pump to the injection pump and the apparatus including a pressure responsive element for adjusting the timing of delivery of fuel by the feed pump.

The object of the invention is to provide an apparatus of the kind specified in a form in which the pressure applied to said element is a function of the speed of operation of the apparatus and the amount of fuel which is being supplied by the apparatus.

According to the invention in an apparatus of the kind specified a flow path is defined in said axially movable member and along which the fuel flows from the feed pump to the injection pump, said flow path including a restrictive orifice, the fuel pressure downstream of said orifice being applied to said pressure responsive element, the fuel pressure downstream of the orifice being dependent on the outlet pressure of the feed pump and also the amount of fuel supplied to the injection pump.

One example of a fuel injection pumping apparatus in accordance with the invention will now be described with reference to the accompanying drawing, a portion of which is a sectional side elevation through the apparatus.

Referring to the drawing, there is provided a housing 10 which accommodates an annular sleeve 11 the latter mounting for rotation, a rotary distributor member 12 which in use, is coupled to a drive shaft of the associated engine so as to rotate in timed relationship therewith.

The distributor member 12 is in known manner, provided with a transversely extending bore which accommodates a pair of pumping plungers which are movable inwardly by means of cam means to effect delivery of fuel. The plungers and cam means constitute an injection pump which is shown diagrammatically at 13. The cam means includes an annular cam ring a portion of which is seen at 14 having cam lobes formed on its internal periphery and the angular setting of the cam ring about the axis of rotation of the distributor member 12 is adjustable in known manner, to vary the timing of delivery of fuel.

The injection pump 13 communicates by way of a longitudinal passage shown diagrammatically at 15, with the inner ends of a plurality of inlet passages 16 which extend to the periphery of the distributor member. Moreover, the passage 15 also communicates with a delivery passage 17 again extending to the periphery of the distributor member and positioned to register in turn with a plurality of outlet ports 18 extending through the sleeve 11 into the housing 10. The outlet ports in use, are connected to injection nozzles 19 respectively of the associated engine. The communication of the delivery passage 17 with an outlet port 18 occurs during the time fuel is being delivered by the injection pump.

Fuel is supplied to the injection pump during the filling strokes by way of an inlet port 20 with which the inlet passages 16 register in turn.

Also provided is a feed pump 21 which in a practical example, is coupled in known manner with the distributor member 12. The output pressure of the feed pump 21 is controlled by means of a valve 22 whereby the pressure varies in accordance with the speed at which the apparatus is driven, the pressure rising as the speed increases.

In the housing 10 there is formed a radially extending bore 23 in which is located an axially movable member 24 and fuel under pressure from the outlet of the feed pump is supplied to the inner end of the bore 23. Conveniently, the bore 23 communicates with a slightly larger bore which is formed in the sleeve 11 and this communicates with the outlet of the feed pump by way of a circumferential groove formed on the periphery of the distributor member. The axially movable member 24 is subjected at its inner end, to the pressure at the outlet of the feed pump and exterior of the bore 23 the member 24 carries an abutment 25 against which bears one end of a coiled compression spring 26. The other end of the spring 26 bears against the adjustable abutment 27 which is slidable within an extension 28 of the housing.

Formed in the member 24 is a flow path comprising an axially extending blind passage 29 which communicates by way of a plurality of transverse drillings, with a circumferential groove 30 formed on the member. Moreover, formed in the wall of the bore 23 is a port 31 which communicates with the inlet passage 20. Fuel flowing to the injection pump 13 must therefore flow by way of the passage 29 and the circumferential groove 30 to the port 31. The axial setting of the member 24 determines the amount by which the port 31 is uncovered and therefore determines the amount of fuel which is supplied to the injection pump during the filling stroke thereof. As the member 24 is moved axially against the action of the spring 26 the effective size of the port 31 is reduced and therefore the amount of fuel flowing to the injection pump is decreased. Since the outlet pressure of the feed pump 21 increases with increasing speed, the member 24 will move with increasing speed against the action of the spring 26 and therefore the member 24 and the spring 26 constitute an hydraulic governor whereby the speed of the associated engine is controlled. The abutment 27 is movable by means of linkage not shown, by the operator of the vehicle who can therefore control the speed of the engine.

As previously mentioned, the cam ring 14 is angularly adjustable and this is achieved by means of a fluid pressure operable piston 32 which is housed within a cylinder and is spring-loaded. The piston conveniently and in known manner, is coupled to the cam ring 14 by means of a radially extending peg mounted in the cam ring the piston being movable by the fluid pressure in a tangential direction. The pressure which is applied to the piston 32 is obtained through a port 38 from the circumferential groove 30 and is therefore responsive to the speed of the associated engine. In order to make the position of the piston responsive to the amount of fuel which is being supplied to the engine, there is incorporated in the blind passage 29, a restrictive orifice 33 and conveniently this is formed in a cup-shaped member 34 which is in screw-thread engagement with the member 24. As fuel flows through the orifice 33 a pressure drop will occur across the orifice, the pressure drop being dependent upon the flow of fuel and therefore the pressure downstream of the orifice will vary in accordance with the flow of fuel through the orifice as well as the pressure upstream of the orifice. Hence, the position of the piston 32 will be dependent both upon the speed of the associated engine and the amount of fuel which is being supplied to the engine. This latter quantity for all practical purposes, being representative of the load on the associated engine.

In some instances the volume of fuel which is delivered by the pump may be small, this applying where a small engine is being supplied with fuel. In such instances it is possible to increase the amount of fuel flowing through the orifice 33 by providing a branch conduit 35 extending between the inlet passage 20 and a drain. The branch conduit contains an orifice 36 and in addition a non-return ball valve 37, the valve 37 closing to prevent flow of fuel through the orifice 36 from the drain, to the injection pump.

In the construction described the orifice 33 is formed in the base wall of a cupshaped insert 34 secured within the blind passage. The orifice 33 may be formed directly in the passage 29 and indeed can be constituted by the passage itself providing the dimensions thereof are correctly chosen.

I claim:

1. A fuel injection pumping apparatus comprising an injection pump operable to deliver fuel during a delivery stroke, a feed pump for supplying fuel to the injection pump during a filling stroke, a housing, a valve within said housing for controlling the output fluid pressure of the feed pump so that the pressure varies in accordance with the speed at which the apparatus is driven, means connecting said feed pump with said injection pump, a throttle within said connecting means for varying the quantity of fuel supplied by the feed pump to the injection pump, said throttle comprising an axially movable member located within a cylindrical portion formed by said housing, said axially moveable member being subjected at one end to said fluid pressure and being movable by an increase in said pressure, resilient means applied to said member in a direction to reduce the amount of fuel supplied by the feed pump to the injection pump said axially moveable member being further provided with a central passage and a groove formed on the outer periphery thereof in communication with said central passage, said passage extending from said one end of said member, an insert secured within said central passage and forming an oriface at the end of said member which is subjected to said fluid pressure, the cylindrical portion formed by said housing and retaining said member including a port in the wall thereof formed by said housing and connecting with said injection pump, the groove and port having variable communication, the extent of which determines the volume of fuel supplied to the injection pump, and fluid pressure responsive means for adjusting the timing of delivery of fuel by said feed pump.

2. An apparatus according to claim 1 including a further port formed in the wall of said cylindrical portion, said further port communicating with said groove and acting to communicate the fluid pressure downstream of said orifice with said pressure responsive means.

3. An apparatus according to claim 1 including means forming a further orifice connecting with said first mentioned port through which fuel can flow to a drain.

4. An apparatus according to claim 3 including a non-return valve in series with said further orifice and acting to prevent flow of fuel through said further orifice to the injection pump.

* * * * *